US008757964B2

(12) United States Patent
Yamashita et al.

(10) Patent No.: US 8,757,964 B2
(45) Date of Patent: Jun. 24, 2014

(54) ROTARY MACHINE SCROLL STRUCTURE AND ROTARY MACHINE

(75) Inventors: Shoki Yamashita, Tokyo (JP); Toshihiro Inoue, Tokyo (JP)

(73) Assignees: Pebble Bed Modular Reactor (Pty) Limited, Centurion (ZA); Mitsubishi Heavy Industries, Ltd., Tokyo (JP)

( * ) Notice: Subject to any disclaimer, the term of this patent is extended or adjusted under 35 U.S.C. 154(b) by 856 days.

(21) Appl. No.: 12/747,978

(22) PCT Filed: Mar. 27, 2009

(86) PCT No.: PCT/JP2009/056927

§ 371 (c)(1),
(2), (4) Date: Aug. 16, 2010

(87) PCT Pub. No.: WO2009/123300

PCT Pub. Date: Oct. 8, 2009

(65) Prior Publication Data

US 2010/0296923 A1 Nov. 25, 2010

(30) Foreign Application Priority Data

Mar. 31, 2008 (JP) ..... 2008-093734

(51) Int. Cl.
*F01D 25/28* (2006.01)

(52) U.S. Cl.
USPC ..... 415/136

(58) Field of Classification Search
USPC ..... 415/136
See application file for complete search history.

(56) References Cited

U.S. PATENT DOCUMENTS 5,081,833 A 1/1992 Mezzedimi et al.
5,232,340 A 8/1993 Morgan
2005/0053463 A1 3/2005 Kopp et al.
2005/0100441 A1 5/2005 Nguyen et al.
2005/0271511 A1 12/2005 Pasquiet

FOREIGN PATENT DOCUMENTS

CN 1865667 A 11/2006
EP 1860284 A1 11/2007
GB 805545 12/1958

(Continued)

OTHER PUBLICATIONS

Chinese Office Action dated Sep. 25, 2012, issued in corresponding Chinese Patent Application No. 200980101457.9 (6 pages) w/ English translation only.
Japanese Office Action dated Mar. 21, 2012, issued in corresponding Japanese Patent Application No. 2010-524011.

(Continued)

*Primary Examiner* — Nathaniel Wiehe
*Assistant Examiner* — Brian O Peters
(74) *Attorney, Agent, or Firm* — Westerman, Hattori, Daniels & Adrian, LLP

(57) ABSTRACT

A scroll structure of a rotary machine and a rotary machine is provided in which it is possible to achieve an improvement in reliability and functionality of a rotary machine such as a turbine and to achieve a reduction in size. Provided are a scroll main body that entirely covers an area surrounding an annular channel extending in a circular shape about a rotational axis in a rotating portion of a rotary machine and a cylindrical channel extending from the annular channel at the rotational axis side and extending towards the rotating portion; and a fitting portion that supports the scroll main body with respect to a support portion and a casing accommodating the scroll main body so as to enable expansion and contraction in a radial direction centered on the rotational axis, while restraining the scroll main body in the direction along the axial axis.

3 Claims, 8 Drawing Sheets

(56) References Cited

FOREIGN PATENT DOCUMENTS

| | | | |
|---|---|---|---|
| JP | 60-006077 | A | 1/1985 |
| JP | 1-117929 | A | 5/1989 |
| JP | 4-209902 | A | 7/1992 |
| JP | 2002-54447 | A | 2/2002 |
| JP | 2002-349276 | A | 12/2002 |
| JP | 2004-169655 | A | 6/2004 |
| JP | 2004-176911 | A | 6/2004 |
| JP | 2007-218119 | A | 8/2007 |
| JP | 36-7053 | | 10/2011 |
| RU | 2004-107995 | A | 9/2005 |
| RU | 2005-110332 | A | 10/2006 |

OTHER PUBLICATIONS

International Search Report of PCT/JP2009/056927, Mailing Date of Jul. 6, 2010.

Written Opinion of the International Searching Authority (PCT Form ISA/237) issued for corresponding International Patent Application No. PCT/JP2009/056927 with PCT Form ISA/220.

Decision to Grant a Patent dated Jul. 24, 2012, issued in corresponding Japanese Patent Application No. 2010-524011, with English translation (7 pages).

Japanese Office Action dated Jul. 26, 2011, issued in corresponding Japanese Patent Application No. 2010-524011.

Russian Office Action dated Dec. 16, 2011, issued in corresponding Russian Patent Application No. 2010125706.

Chinese Office Action dated May 13, 2013, issued in Chinese Patent Application No. 200980101457.9 w/English Translation.

ROTARY MACHINE SCROLL STRUCTURE AND ROTARY MACHINE

TECHNICAL FIELD

The present invention relates to a rotary machine scroll structure used for a rotary machine such as a steam turbine and a gas turbine, as well as to the rotary machine.

BACKGROUND ART

Generally, a scroll structure used for a rotary machine such as a turbine is disposed in front of a first stator blade (inflow side of working fluid) or behind a last rotor blade (outflow side of working fluid) in a turbine using heated steam or heated gas as the working fluid, and the scroll structure is a sheet metal welded structure through which the working fluid flows (see Patent document 1 for example).

A conventional scroll structure includes an upper casing and a lower casing which are divided by a horizontal surface, and the upper casing and the lower casing are fastened to each other using a bolt (see Patent document 2 for example).

The scroll structure has a heat shield effect with respect to a peripheral stationary member, and a rectifying effect for working fluid.

When working fluid which flows into or out of a turbine is high temperature, the scroll structure shields radiant and heat transfer from the working fluid, and prevents rise in temperature of a member in the peripheral stationary member such as an inner casing.

In this case, a material having high strength at a high temperature is selected as a material for the scroll structure. Further, in order to satisfy the material strength required to the scroll structure, an outer peripheral surface of the scroll structure is sprayed with cooling fluid to decrease the temperature of the scroll structure.

A channel in front of a first stator blade or behind a last rotor blade in the scroll structure is formed into such a shape that aerodynamics are taken into consideration so as to rectify working fluid. In this configuration, a pressure loss of the working fluid is suppressed, and the performance of the turbine is improved.

Patent document 1 Japanese Unexamined Patent Application, Publication No. H1-117929

Patent document 2 Japanese Examined Patent Application, Publication No. S60-6077

DISCLOSURE OF INVENTION

In a case where the scroll structure is divided into two pieces by the horizontal surface as described above, the upper casing and the lower casing are provided with connecting flanges. Thus, there is a problem that the scroll structure is increased in size.

When the scroll structure is increased in size, a stationary part or the like which is disposed on an outer peripheral of the scroll structure such as an inner casing is also increased in size, and there are problems that the weight of the turbine is increased and cost for the materials is increased.

In a case where there is a difference in pressure between an inside and an outside of the scroll structure, there are problems that working fluid leaks from a joint surface between the upper casing and the lower casing, fluid outside the scroll structure, e.g., air is inhaled from the joint surface and the fluid flows into the turbine and therefore the performance of the turbine is influenced.

Further, in a structure in which the upper casing and the lower casing are fastened to each other using a bolt, it is necessary to secure an operation space where the scroll structure is assembled or disassembled, and the shape of the channel in the scroll structure is limited. In other words, a complicated shape in which aerodynamics are taken into consideration and a shape in which the scroll structure can be assembled or disassembled are not compatible with each other in terms of the structure.

In the conventional scroll structure, higher priority is given to the shape in which the scroll structure can be assembled or disassembled, and as a result, a shape of the channel in the scroll structure is not a shape in which aerodynamically loss is minimized, and there is problem that a pressure loss of working fluid is generated.

The present invention has been accomplished to solve the above problems, and it is an object of the present invention to provide a rotary machine scroll structure and a rotary machine capable of improving reliability and performance of the rotary machine, and of reducing in size the rotary machine and the scroll structure.

In order to achieve the above objects, the present invention provided the following means.

According to a first aspect of the present invention, a rotary machine scroll structure includes: a casing that entirely covers an area surrounding an annular channel extending in a circular shape about a rotational axis in a rotating portion of the rotary machine and a cylindrical channel extending from the annular channel towards the rotational axis side and also extending towards the rotating portion; and a fitting portion that supports the casing with respect to a support portion accommodating the casing so as to enable expansion and contraction in a radial direction centered on the rotational axis.

According to the above aspect, since the casing is integrally formed in one piece, a working fluid is prevented from leaking outside, and another fluid is prevented from flowing into the casing from outside which may be caused by inhalation of the other fluid. That is, in a case where the casing is divided into two pieces, i.e., into the upper casing and the lower casing, there is an adverse possibility that the working fluid leaks from the joint surface between the upper casing and the lower casing. In the case of the integrally formed casing, however, since there is no joint surface, it is possible to reliably prevent the working fluid from leaking.

When the casing is integrally formed in one piece, the cylindrical channel can be formed into such a shape that a pressure loss thereof is suppressed as compared with a case where the casing is divided into two pieces. That is, when the casing is divided into two pieces, a space for disposing a member such as a bolt which fastens the upper casing and the lower casing and a space where the bolt is attached or detached must be secured, so that the shape of the cylindrical channel is limited. To the contrary, in the case of the integrally formed casing, it is unnecessary to use the fastening bolt. Therefore, the shape of the channel is not limited, and a channel shape having a small pressure loss can be employed.

By the casing integrally formed in one piece, the scroll structure can be reduced in size as compared with the case where the casing is divided into two pieces. That is, when the casing is divided into two pieces, flanges used for fastening the upper casing and the lower casing to each other project outward from the casings. On the other hand, when the casing is integrally formed in one piece, it is unnecessary to provide the flanges. Therefore, the casing can be reduced in size.

As the casing is supported by the fitting portion such that the casing can expand and contract along the radial direction, misalignment of the casing caused by restraining deformation of the casing can be prevented, and damage to the casing caused by high stress can be prevented.

For example, in a case where even a single fixed point is provided to the casing, misalignment of the casing may be caused by uneven deformation. When the fixed point is provided, there is an adverse possibility that thermal deformation of the casing is restrained to cause thermal stress, and the casing is damaged.

When the casing is supported such that the casing can expand and contract along the radial direction, distortion of the shape of the casing is suppressed, and the working fluid is prevented from leaking from a connected portion with another member.

Thermal deformation of the casing is not restrained, and misalignment and thermal stress of the casing can be suppressed.

Examples of the rotary machines include general fluid machines such as a steam turbine, a compressor, and a pump.

In the above aspect, it is preferable that the fitting portion includes: a first protrusion disposed on one of the casing and the support portion and protruding in one direction along the radial direction; a first groove which is disposed on the other one of the casing and the support portion, which is open towards another direction along the radial direction, which extends in a circumferential direction of the rotational axis, and into which the first protrusion is fitted; and a first depression which is formed by indenting one wall constituting the groove is depressed in one direction along the radial direction and through which the first protrusion passes by moving relative to the one wall in a direction along the rotational axis.

According to the above aspect, the casing is supported such that it can expand and contract along the radial direction, and movement of the casing in the direction extending along the rotational axis is restricted.

Specifically, the first protrusion projecting in one of the directions along the radial direction is opened in the other direction along the radial direction, and the first protrusion is fitted into the first groove extending in the circumferential direction. In this configuration, relative movement between the first protrusion and the first groove along the rotational axis is restricted. On the other hand, relative movement between the first protrusion and the first groove in the radial direction is permitted.

Even when the rotation shaft of the rotary machine penetrates the casing, the casing can be supported such that it can expand and contract along the radial direction and movement of the casing in the direction along the rotational axis can be restricted.

More specifically, the first protrusion is disposed in the first groove by moving the first protrusion in the direction along the rotational axis to pass through the first depression, and the rotation shaft of the rotary machine penetrates the casing. Thereafter, the first protrusion is rotated in the circumferential direction, and the first protrusion is disposed in a region of the first groove where the first depression is not provided, in other words, a region where a pair of walls are opposed to each other. Accordingly, relative movement between the first protrusion and the first groove along the direction of the rotational axis is restricted.

In the above embodiment, it is preferable that the fitting portion includes: a second protrusion which is disposed on one of the casing and the support portion and which protrudes in one direction along the radial direction; and a second depression which is disposed on the other one of the casing and the support portion, which is open towards another direction along the radial direction, and into which the second protrusion is fitted.

According to the above aspect, the casing is supported such that it can expand and contract in the radial direction, and movement of the casing in the direction intersecting with the rotational axis is restricted.

Specifically, the second protrusion which projects in one direction along the radial direction is fitted into the second depression which is depressed in the one direction along the radial direction. In this configuration, relative movement between the second protrusion and the second depression in the direction intersecting with the rotational axis is restricted. On the other hand, relative movement between the second protrusion and the second depression in the radial direction is permitted.

In a second aspect of the present invention, a rotary machine includes: a scroll structure according to the first aspect; and a rotating portion into which or from which a working fluid flows, between the rotating portion and the scroll structure, and which extracts a rotational driving force from the supplied working fluid.

According to the above aspect, since the rotary machine includes the scroll structure of the first aspect, leak of the working fluid which flows into or from the rotating portion can reliably be prevented, and reliability of the rotary machine is improved.

Since the rotary machine includes the scroll structure of the first aspect, a pressure loss of the working fluid which flows into or from the rotating portion can be reduced, and performance of the rotary machine is improved.

Since the rotary machine includes the scroll structure of the first aspect, the casing is reduced in size, and the rotary machine is thus reduced in size.

In the rotary machine scroll structure and the rotary machine according to the present invention, since the casing is integrally formed in one piece, there are effects that reliability and performance of the rotary machine are improved and the rotary machine and the scroll structure can be reduced in size.

Further, since the casing is supported by the fitting portion such that the casing can expand and contract along the radial direction, there is an effect that reliability and performance of the rotary machine can be improved.

BEST MODE FOR CARRYING OUT THE INVENTION

A scroll structure according to an embodiment of the present invention and a gas turbine having the scroll structure will be described with reference to FIGS. 1 to 10.

Figure 1:
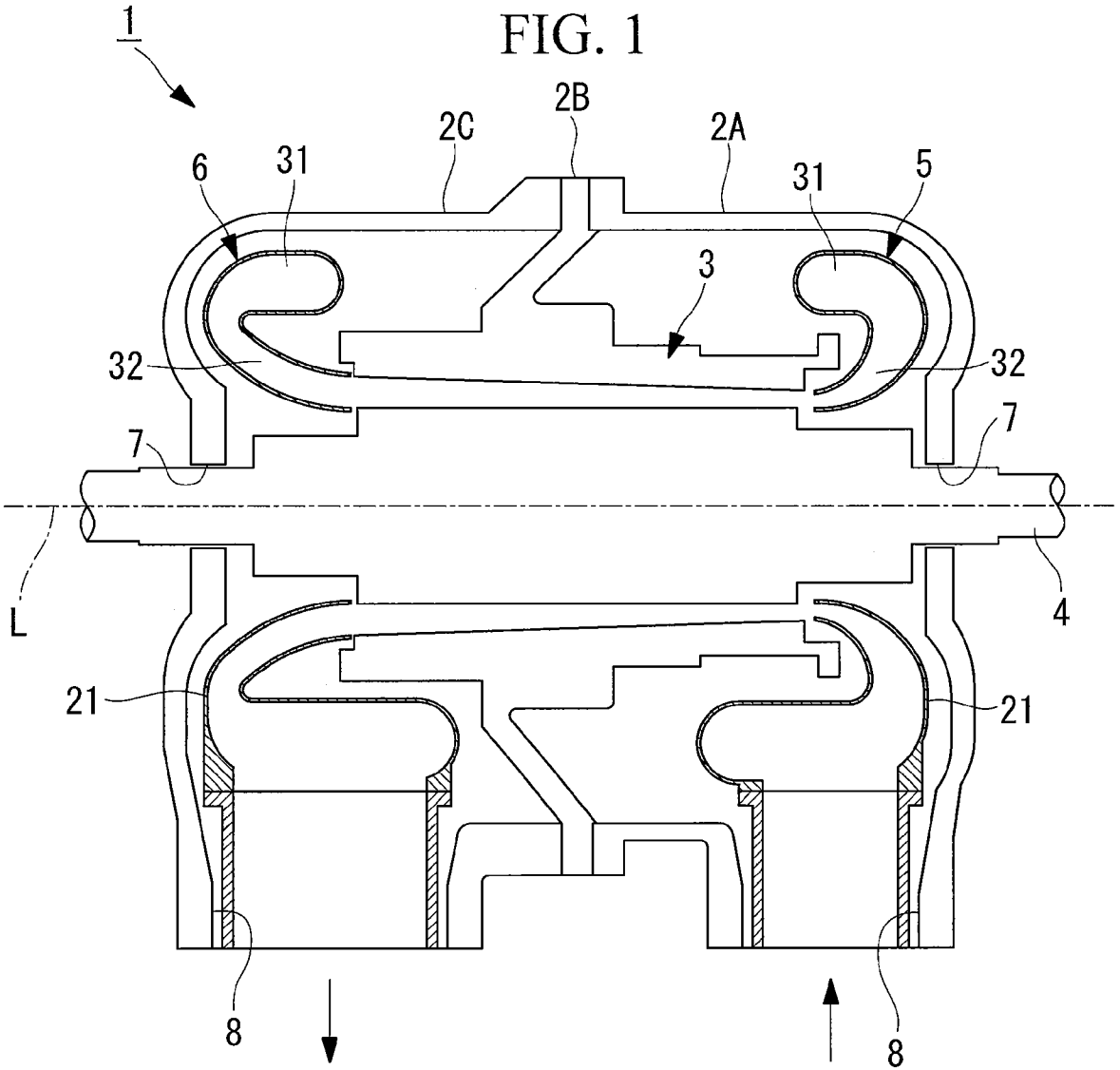
FIG. 1 is a schematic diagram for describing an entire configuration of a gas turbine according to an embodiment of the present invention.

FIG. 1 is a schematic diagram for describing an entire configuration of the gas turbine according to the present embodiment.

A gas turbine 1 includes casings 2A, 2B and 2C constituting an outer shape of the gas turbine 1, a turbine portion 3 which extracts a rotational driving force from a supplied working fluid, a rotation shaft 4 which is rotated and driven around a rotational axis L by the turbine portion 3, an inlet scroll portion 5 which supplies the working fluid to the turbine portion 3, and a discharge scroll portion 6 into which the working fluid discharged from the turbine portion 3 flows.

As shown in FIG. 1, the casings 2A and 2C constitute the outer shape of the gas turbine 1 together with the casing 2B. The turbine portion 3, the rotation shaft 4, the inlet scroll portion 5 and the discharge scroll portion 6 are accommodated in the casings 2A and 2C. The casings 2A and 2C are substantially cylindrical members of which one ends are closed. In other words, the casings 2A and 2C are bottomed cylindrical members, so-called pot-like members. Open ends of the casings 2A and 2C are butted against each other, and are fastened to each other with the casing 2B interposed therebetween.

A through hole 7 is formed in the closed ends of the casings 2A and 2C, and the rotation shaft 4 is inserted through the through hole 7. An opening 8 is formed in cylindrical surfaces of the casings 2A and 2C, and a tube through which the working fluid flows in or out is inserted through the opening 8.

As shown in FIG. 1, the casing 2B constitutes the outer shape of the gas turbine 1 together with the casings 2A and 2C, and supports the turbine portion 3.

The casing 2B is a substantially disk-like member extending in a radial direction centered on the rotational axis L, and is interposed between the casings 2A and 2C.

Figure 4:
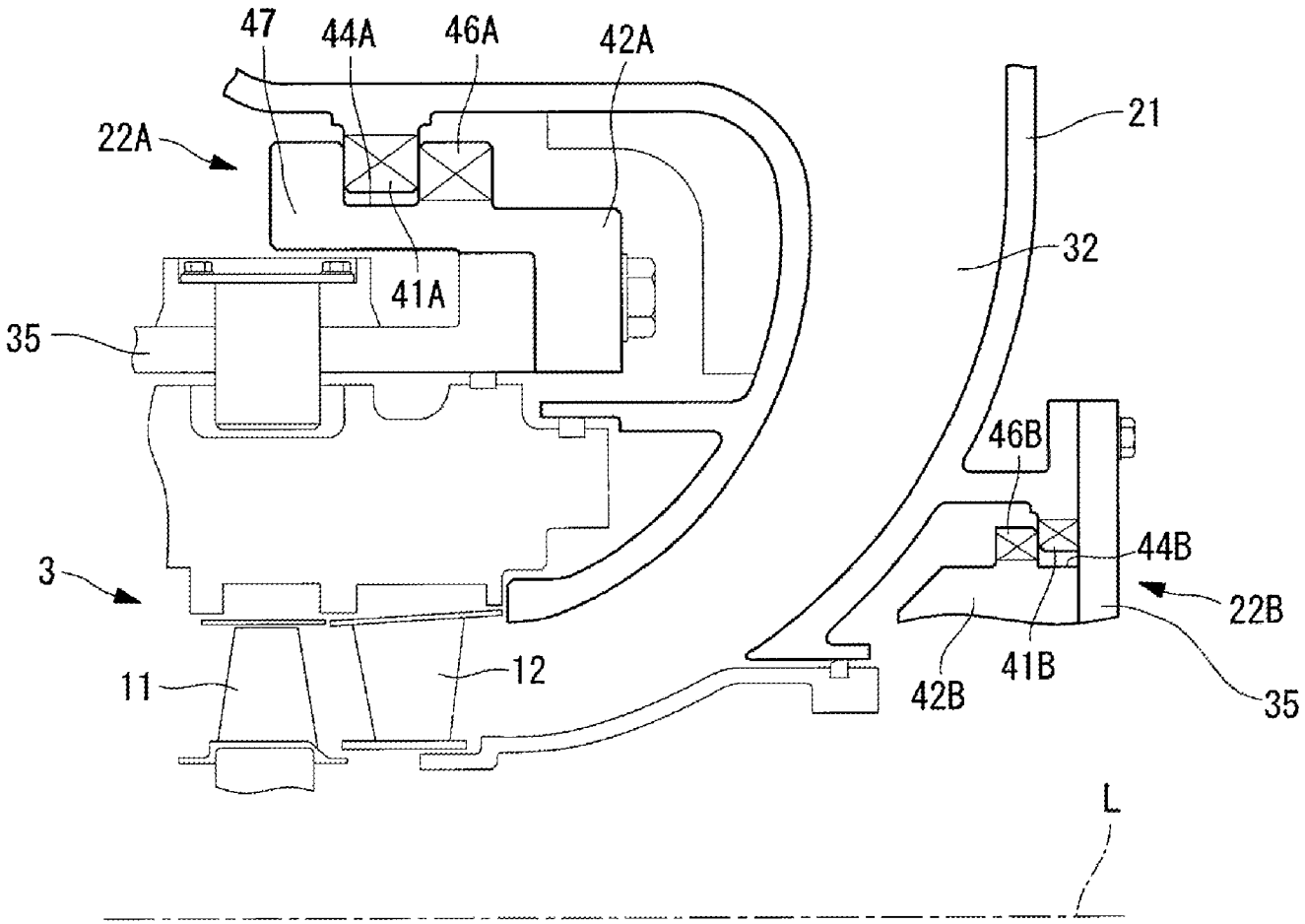
FIG. 4 is a partial enlarged sectional view for describing a configuration of a turbine portion-side restraining portion and a casing-side restraining portion shown in FIGS. 2 and 3.

As shown in FIG. 1, the turbine portion 3 includes a rotor blade 11 and a stator blade 12 (see FIG. 4). The turbine portion 3 extracts a rotational driving force from the working fluid supplied from the inlet scroll portion 5, and rotates and drives the rotation shaft 4.

A known configuration can be used for the turbine portion 3, and the configuration thereof is not especially limited.

The rotation shaft 4 is rotated and driven around the rotational axis L by the turbine portion 3 as shown in FIG. 1.

As shown in FIG. 1, the working fluid passes through the inlet scroll portion 5 and the discharge scroll portion 6, and the working fluid is supplied to the turbine portion 3 as well as the working fluid discharged from the turbine portion 3 flows into the inlet scroll portion 5 and the discharge scroll portion 6. Since the basic configurations of the inlet scroll portion 5 and the discharge scroll portion 6 are substantially the same, only the inlet scroll portion 5 will be described below and description of the configuration of the discharge scroll portion 6 is omitted.

Figure 2:
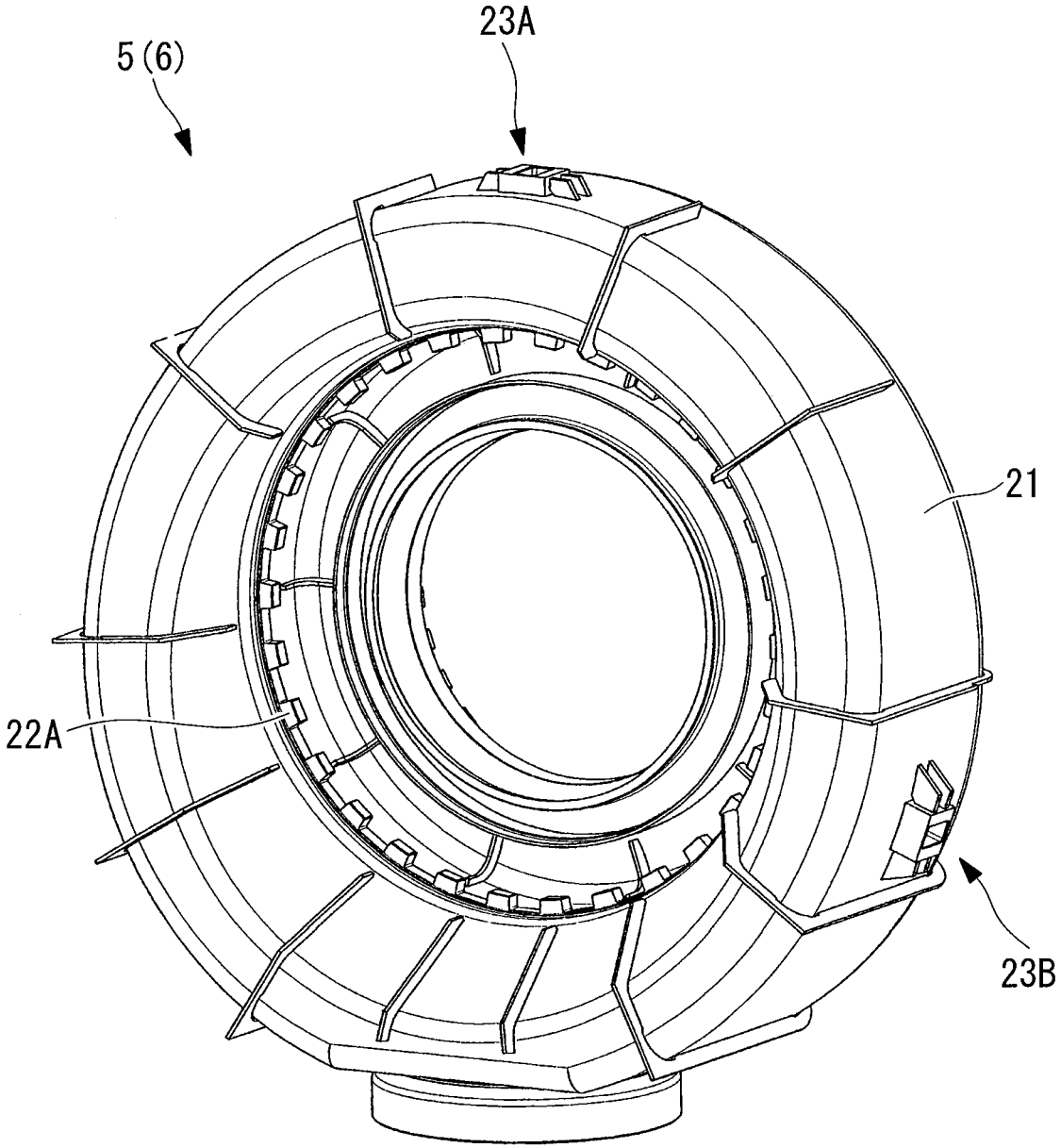
FIG. 2 is a perspective view for describing a configuration of an inlet scroll portion shown in FIG. 1 as viewed from the turbine portion.
Figure 3:
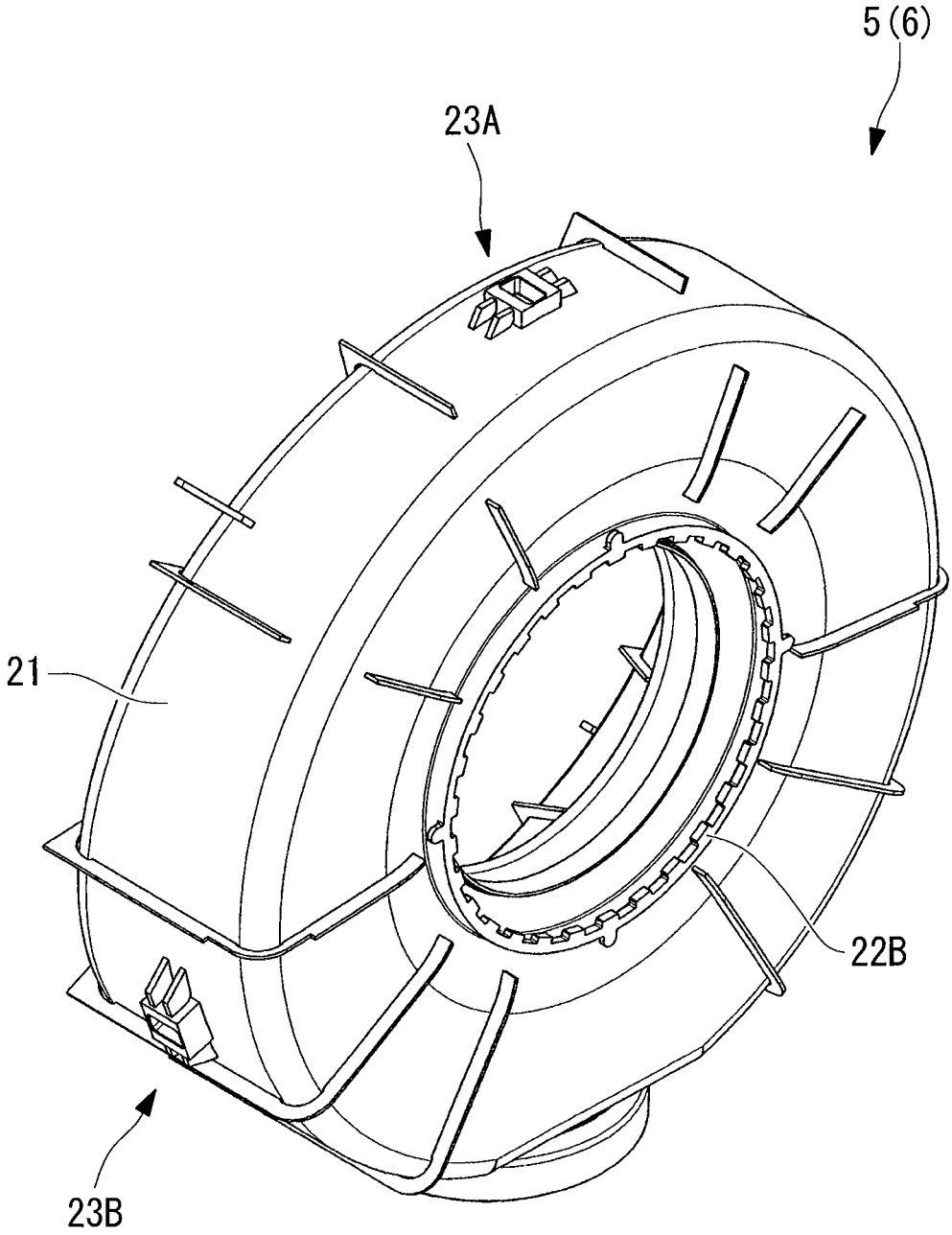
FIG. 3 is a perspective view for describing the configuration of the inlet scroll portion shown in FIG. 1 as viewed from a casing.

FIG. 2 is a perspective view for describing the configuration of the inlet scroll portion shown in FIG. 1 as viewed from the turbine portion. FIG. 3 is a perspective view for describing the configuration of the inlet scroll portion shown in FIG. 1 as viewed from the casing.

As shown in FIGS. 2 and 3, the inlet scroll portion 5 includes a scroll main body 21 constituting the outer shape of the inlet scroll portion 5, a turbine portion-side restraining portion 22A, a casing-side restraining portion 22B, a horizontal restraining portion 23A, and a vertical restraining portion 23B. These restraining portions support the scroll main body 21 with respect to the casing 2A such that the scroll can expand and contract along the radial direction centered on the rotational axis L, and restrain movement of the scroll main body 21 in a direction along the rotational axis L.

As shown in FIGS. 2 and 3, the scroll main body 21 is integrally formed into a ring shape provided at a central portion with an opening through which the rotation shaft 4 is inserted. As shown in FIG. 1, the scroll main body 21 is provided therein with an annular channel 31 extending annularly around the rotational axis L, and a cylindrical channel 32 extending from the annular channel 31 toward the rotational axis L up to the turbine portion 3.

FIG. 4 is a partial enlarged sectional view for describing configurations of the turbine portion-side restraining portion and the casing-side restraining portion shown in FIGS. 2 and 3.

As shown in FIG. 4, the turbine portion-side restraining portion 22A is provided in the scroll main body 21 on the side of the turbine portion 3. The turbine portion-side restraining portion 22A supports the scroll main body 21 such that the scroll main body 21 can expand and contract in the radial direction centered on the rotational axis L, and restrains movement of the scroll main body 21 in the direction along the rotational axis L. The casing-side restraining portion 22B is provided in the scroll main body 21 on the side of the casing 2A. The casing-side restraining portion 22B supports the scroll main body 21 such that the scroll main body 21 can expand and contract in the radial direction centered on the rotational axis L and restrains movement of the scroll main body 21 in the direction along the rotational axis L.

As shown in FIG. 1, the annular channel 31 has an annular shape into which the working fluid heated from outside flows. A cross sectional area of the channel is gradually reduced from a lower portion (lower portion in FIG. 1) to an upper portion along which the working fluid flows from outside. By forming the annular channel 31 in this shape, a flow velocity of the working fluid which flows into the turbine portion 3 is substantially equalized in the circumferential direction.

As shown in FIGS. 1 and 4, the cylindrical channel 32 extends from an inner periphery of the annular channel 31 toward the rotational axis L as well as extends toward the turbine portion 3. The cylindrical channel 32 has such a shape that a pressure loss of the working fluid flowing through the cylindrical channel 32 is minimized.

In the cylindrical channel 32 in the inlet scroll portion 5, the working fluid which flows into the turbine portion 3 from the annular channel 31 flows. In the cylindrical channel 32 in the discharge scroll portion 6, the working fluid which flows into the annular channel 31 from the turbine portion 3 flows.

Figure 5:
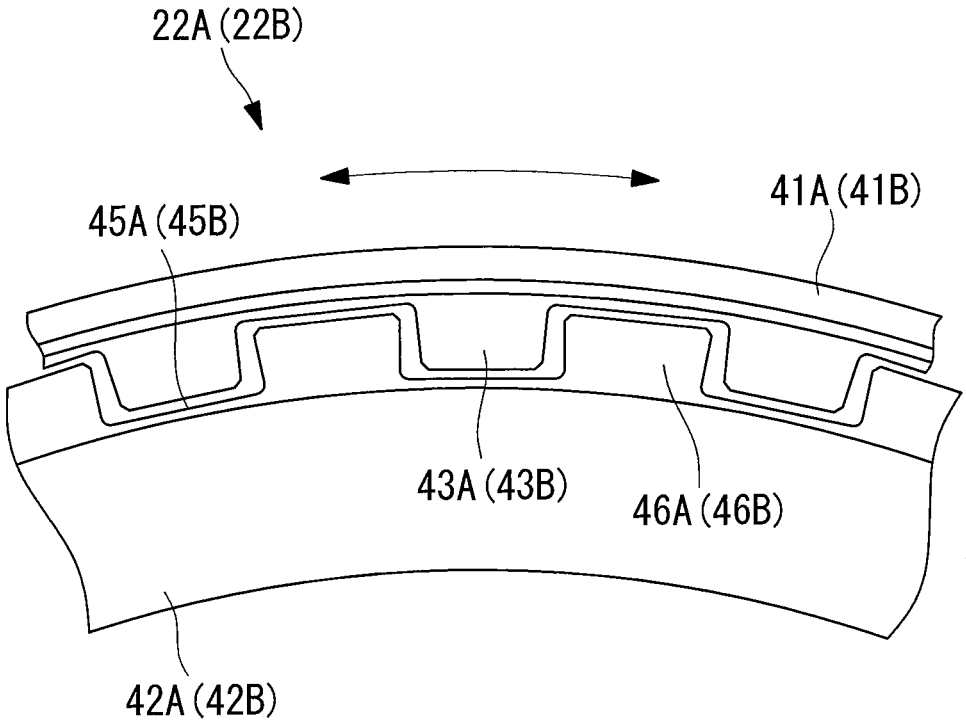
FIG. 5 is a partial enlarged view for describing a configuration of the turbine-side restraining portion shown in FIG. 4.
Figure 6:
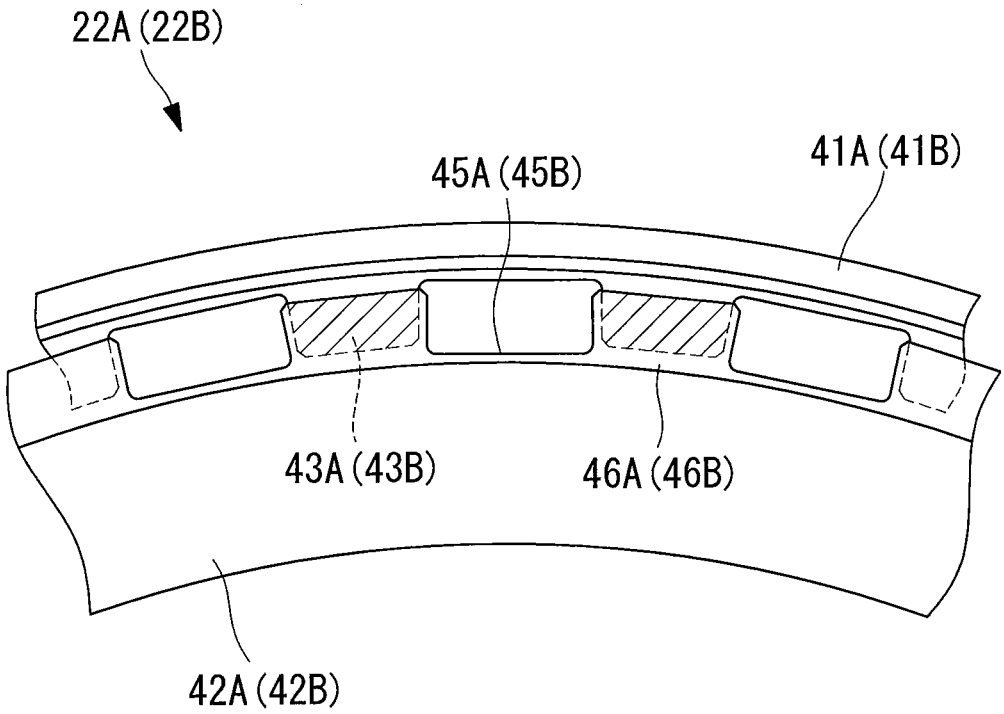
FIG. 6 is a partial enlarged view for describing the configuration of the turbine-side restraining portion shown in FIG. 4.

FIGS. 5 and 6 are partial enlarged views for describing a configuration of the turbine-side restraining portion shown in FIG. 4.

As shown in FIGS. 4 and 5, the turbine portion-side restraining portion 22A supports the scroll main body 21 such that it can expand and contract in the radial direction, and restrains movement of the scroll main body 21 in the direction along the rotational axis L.

The turbine portion-side restraining portion 22A is provided with an outer ring 41A which is disposed on an inner peripheral surface of the scroll main body 21, and with an inner ring 42A fixed to a support portion 35 which is connected to the casing 2A.

The outer ring 41A is provided with first protrusions 43A which project radially inward and which are disposed at equal distances from one another in the circumferential direction. The distances of the first protrusions 43A correspond to the distances of later-described first depressions 45A.

The first protrusions 43A are fitted into later-described first grooves 44A, thereby restraining movements of the scroll main body 21 in the direction along the rotational axis L.

The inner ring 42A is provided with first grooves 44A which are opened radially outward and extend in the circumferential direction, and first depressions 45A which are formed in a first wall portion 46A of a pair of wall portions located on the side of the scroll main body 21, and which are depressed radially inward. The pair of wall portions constitute the first groove 44A, between the first wall portion 46A and a second wall portion 47.

The first grooves 44A are fitted to the first protrusions 43A, restrain movement of the scroll main body 21 in the direction along the rotational axis L, and permit movement of the first protrusions 43A in the circumferential direction.

When the first protrusions 43A are fitted to or separated from the first grooves 44A, the first protrusions 43A move in the direction along the rotational axis L and pass through the first depressions 45A. The first depressions 45A are provided as many as the first protrusions 43A at equal distances from one another in the circumferential direction. The distances between the first depressions 45A correspond to the distances between the first protrusions 43A.

In this configuration, the first protrusions 43A can pass through the first depressions 45A and move in the direction along the rotational axis L.

The relative position between the outer ring 41A and the inner ring 42A shown in FIG. 5 shows a positional relation in a case where the first protrusions 43A pass through the first depressions 45A. The relative position between the outer ring 41A and the inner ring 42A shown in FIG. 6 shows a positional relation in a case where the first protrusions 43A rotate in the circumferential direction and restrain movement of the scroll main body 21 in the direction along the rotational axis L.

As shown in FIG. 4, the casing-side restraining portion 22B supports the scroll main body 21 such that it can expand and contract in the radial direction and restrains movement of the scroll main body 21 in the direction along the rotational axis L.

The casing-side restraining portion 22B is provided with an outer ring 41B which is disposed on a surface of the scroll main body 21 opposed to the casing 2A, and with an inner ring 42B fixed to the support portion 35 which is connected to the casing 2A.

Like the outer ring 41A, the outer ring 41B is provided with first protrusions 43B which project radially inward and which are disposed at equal distances from one another in the circumferential direction.

Like the inner ring 42A, the inner ring 42B is provided with a first groove 44B which opens radially outward and which extends in the circumferential direction, and with a first depression 45B which is depressed radially inward and which is formed in a first wall portion 46B of the first groove 44B on the side of the scroll main body 21.

Figure 7:
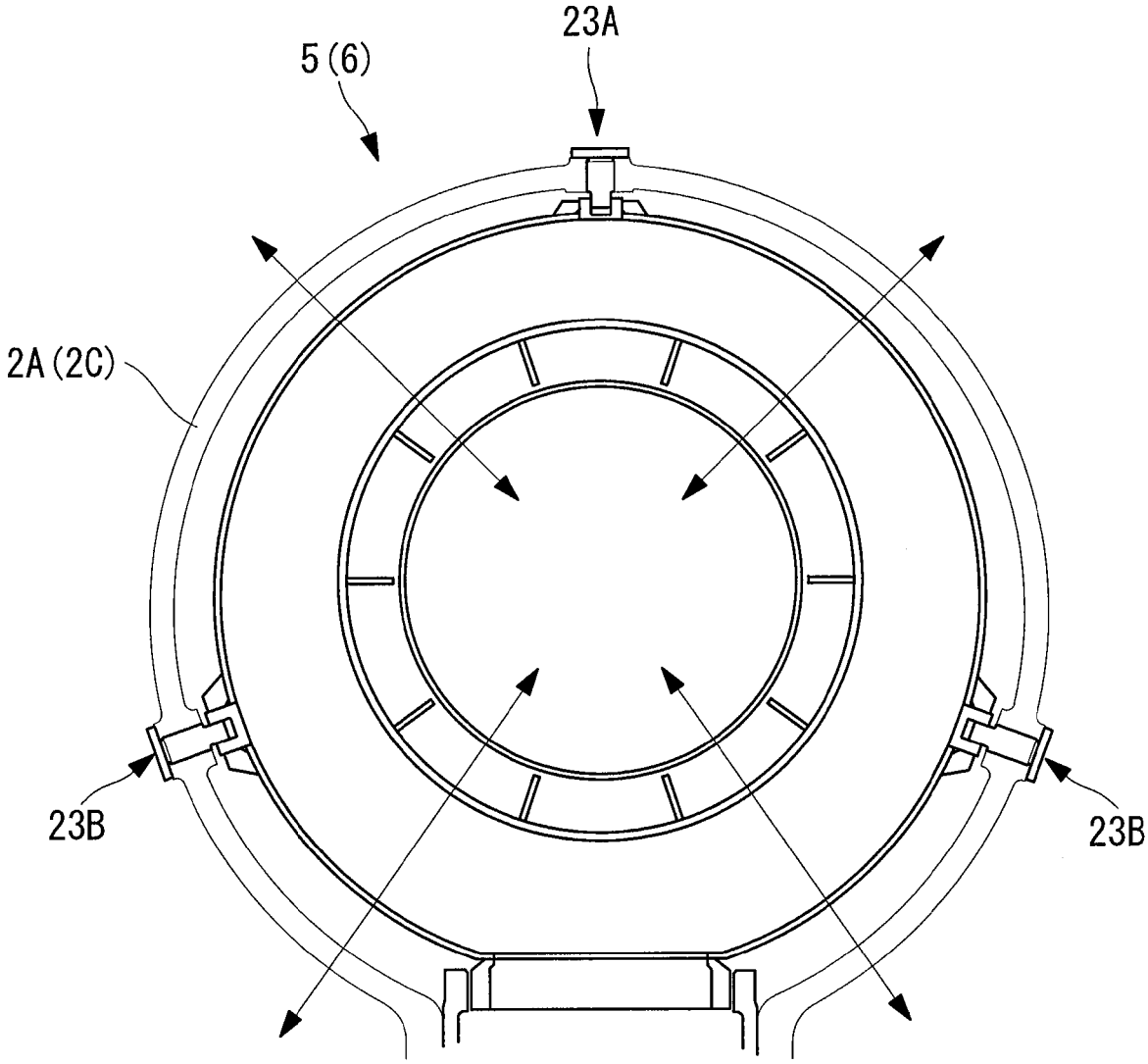
FIG. 7 is a sectional view for describing a disposition of a horizontal restraining portion and a vertical restraining portion shown in FIG. 2.

FIG. 7 is a sectional view for describing positions of the horizontal restraining portion and the vertical restraining portion shown in FIG. 2.

As shown in FIG. 7, the horizontal restraining portion 23A and the vertical restraining portion 23B support the scroll main body 21 such that it can expand and contract in the radial direction, and restrain movement of the scroll main body 21 in the horizontal direction intersecting with the rotational axis L as well as in the vertical direction.

The horizontal restraining portion 23A is disposed on an upper end (upper side end in FIG. 7) of the scroll main body 21, and restrains movement of the scroll main body 21 in the horizontal direction (lateral direction in FIG. 7) with respect to the casing 2A.

Figure 8:
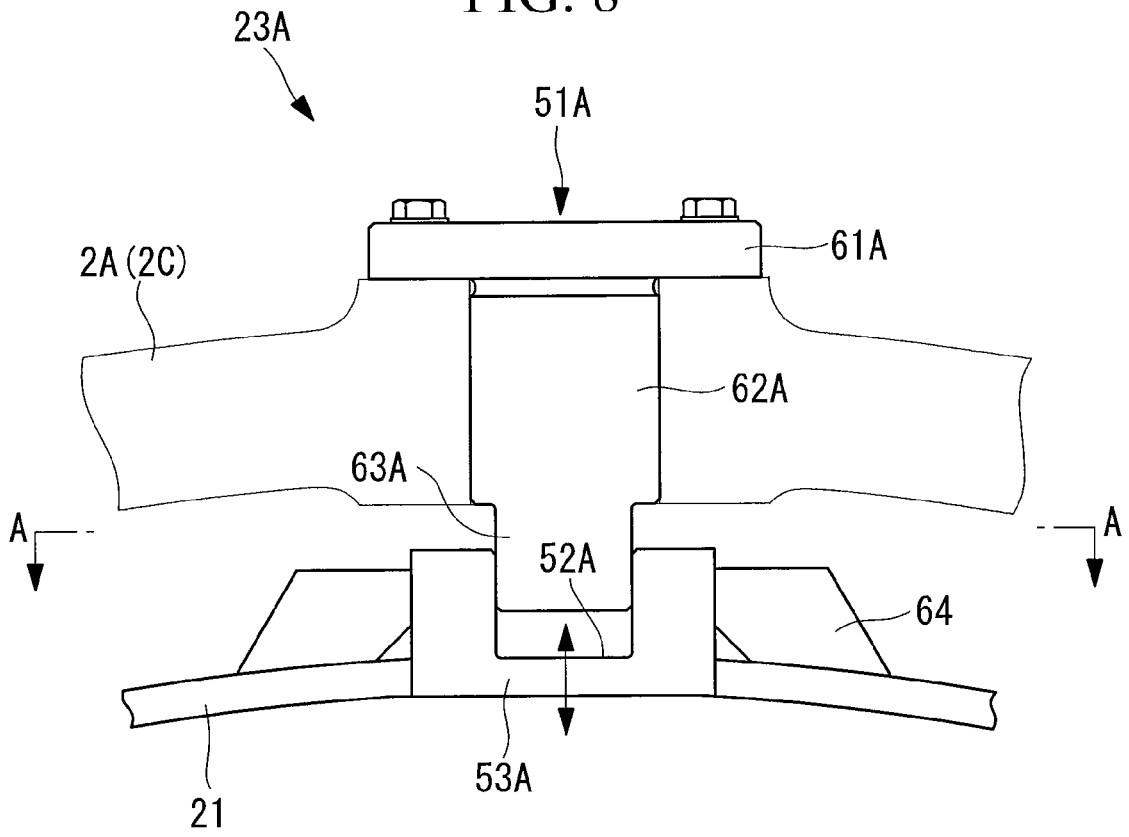
FIG. 8 is a partial enlarged view for describing a configuration of the horizontal restraining portion shown in FIG. 7.
Figure 9:
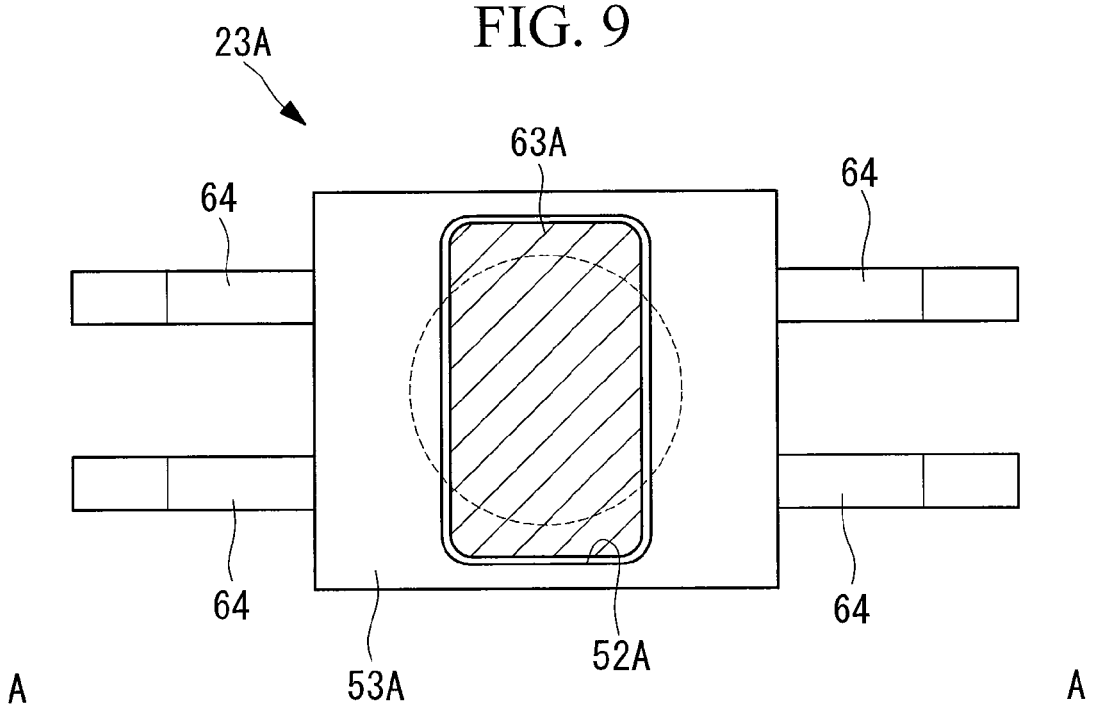
FIG. 9 is a sectional view for describing the configuration of the horizontal restraining portion shown in FIG. 7 taken along line A-A.

FIG. 8 is a partial enlarged view for describing a configuration of the horizontal restraining portion shown in FIG. 7. FIG. 9 is a sectional view for describing the configuration of the horizontal restraining portion shown in FIG. 7 taken along the line A-A.

As shown in FIGS. 8 and 9, the horizontal restraining portion 23A is provided with a second protrusion 51A projecting radially inward from the casing 2A, and a pedestal 53A formed with a second depression 52A which is opened radially outward.

As shown in FIG. 8, the second protrusion 51A includes a brim 61A which abuts against an outer peripheral surface of the casing 2A, a shaft portion 62A which extends radially inward from the brim 61A and which penetrates the casing 2A, and an inserted portion 63A which configures a radially inner end of the shaft portion 62A and which is inserted into the second depression 52A. As shown in FIG. 9, the inserted portion 63A has a rectangular cross section.

As shown in FIG. 8, the pedestal 53A is a rectangular parallelepiped member provided on the scroll main body 21. A rib 64 extending radially outward and in the circumferential direction is provided on a side surface of the pedestal 53A. The second depression 52A is provided on an upper surface of the pedestal 53A, i.e., the surface of the pedestal 53A opposed to the casing 2A.

As shown in FIG. 9, the second depression 52A is a rectangular parallelepiped hole, and the inserted portion 63A is inserted into the second depression 52A.

As shown in FIG. 7, the vertical restraining portion 23B is disposed diagonally below the scroll main body 21, e.g., at a phase rotated downward by about 20° from the horizontal direction, and the vertical restraining portion 23B restrains movement of the scroll main body 21 in the vertical direction (vertical direction in FIG. 7) with respect to the casing 2A.

The phase is not limited to 20° as long as movement in the vertical direction is restrained.

Figure 10:
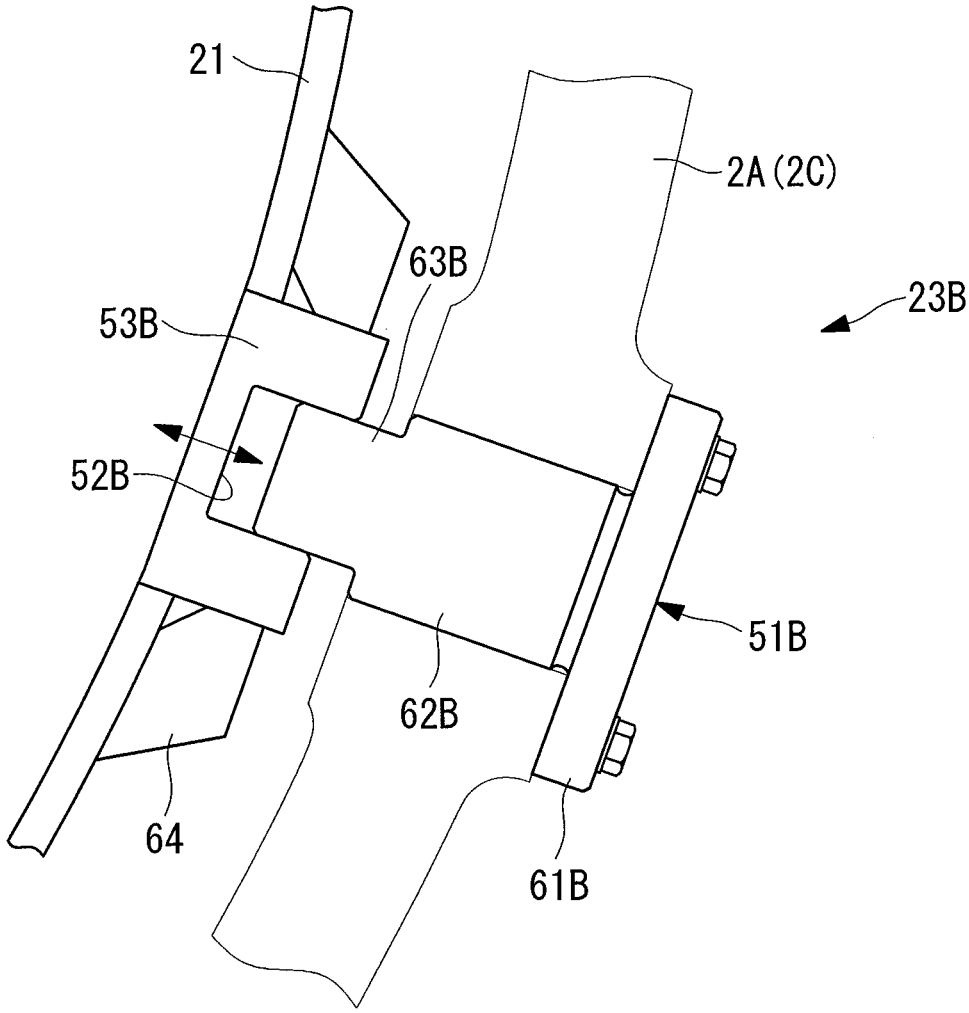
FIG. 10 is a partial enlarged view for describing a configuration of the vertical restraining portion shown in FIG. 7.

FIG. 10 is a partial enlarged view for describing the configuration of the vertical restraining portion shown in FIG. 7.

As shown in FIG. 10, the vertical restraining portion 23B includes a second protrusion 51B projecting radially inward from the casing 2A, and a pedestal 53B formed with a second depression 52B which is opened radially outward.

Since the configurations of respective portions of the vertical restraining portion 23B are the same as those of the horizontal restraining portion 23A, FIG. 10 shows the configuration of the vertical restraining portion 23B and description thereof is omitted.

Next, operation of the gas turbine 1 having the above-described configuration will be described.

As shown in FIG. 1, the working fluid which is heated to high temperature in a high temperature gas furnace flows into the inlet scroll portion 5 of the gas turbine 1. The working fluid which has flowed into the inlet scroll portion 5 flows into the annular channel 31, and then flows into the cylindrical channel 32 at a substantially even flow velocity in the circumferential direction. The working fluid which flowed into the cylindrical channel 32 is introduced into the turbine portion 3 and flows into the turbine portion 3.

As shown in FIGS. 1 and 4, the rotor blade 11 is rotated and driven by the working fluid flowing in the turbine portion 3, and a rotational driving force extracted by the rotor blade 11 is transmitted to the rotation shaft 4. The working fluid of which rotational driving force has been extracted by the turbine portion 3 and of which temperature has been lowered is discharged from the turbine portion 3.

As shown in FIG. 1, the working fluid discharged from the turbine portion 3 flows into the cylindrical channel 32 of the discharge scroll portion 6 and flows toward the annular channel 31. The working fluid which has flowed into the annular channel 31 is discharged from the discharge scroll portion 6, i.e., from the gas turbine 1, and is again introduced into the high temperature gas furnace through a device.

Next, a supporting method of the inlet scroll portion 5 and the discharge scroll portion 6 which are features of the present embodiment will be described.

First, support of the scroll main body 21 by the turbine portion-side restraining portion 22A and the casing-side restraining portion 22B will be described with reference to FIGS. 4 to 6.

When the scroll main body 21 is supported by the support portion 35, as shown in FIGS. 4 and 6, the first protrusions 43A and 43B are disposed respectively in the first grooves 44A and 44B. In this case, the first protrusions 43A and 43B are disposed at positions where they are overlapped with the wall portions 46A and 46B as viewed from the direction along the rotational axis L.

By disposing the first protrusions 43A and 43B at such positions, movement of the scroll main body 21 in the direction along the rotational axis L is restrained. By providing distances between inner peripheral ends of the first protrusions 43A and 43B and bottom surfaces of the first grooves 44A and 44B, the first protrusions 43A and 43B can move in the radial direction with respect to the first grooves 44A and 44B.

Next, a fitting method of the turbine portion-side restraining portion 22A and the casing-side restraining portion 22B will be described.

First, the inner ring 42A of the turbine portion-side restraining portion 22A is fixed to the support portion 35. Thereafter, the scroll main body 21 is fitted to the support portion 35 through the turbine portion-side restraining portion 22A.

More specifically, the first protrusion 43A and the first depression 45A are disposed at the relative positions shown in FIG. 5, in other words, such that the first protrusion 43A is inserted through the first depression 45A and then, the scroll main body 21 is moved toward the turbine portion 3 along the rotational axis L.

Once the first protrusion 43A is moved into the first groove 44A, the first protrusion 43A is moved in the circumferential direction, and the first protrusion 43A is rotated to a location where it is overlapped with the wall portion 46A as viewed from the direction along the rotational axis L as shown in FIG. 6. Accordingly, fitting operation of the turbine portion-side restraining portion 22A is completed.

By this operation, the rotation shaft 4 is inserted through the integrally formed scroll main body 21 as well as the scroll main body 21 is supported such that it can expand and contract along the radial direction. At the same time, movement of the scroll main body 21 in the direction along the rotational axis L can be restrained.

More specifically, the first protrusion 43A passes through the first depression 45A while moving the first protrusion 43A in the direction along the rotational axis L. Accordingly, the first protrusion 43A is disposed in the first groove 44A and the rotation shaft 4 penetrates the scroll main body 21. Thereafter, the first protrusion 43A is rotated in the circumferential direction, and the first protrusion 43A is disposed in a region of the first groove 44A where the first depression 45A is not provided, in other words, in a region of the first groove 44A where the pair of wall portions are opposed to each other. Thus, movement of the scroll main body 21 in the direction along the rotational axis L is restrained.

Next, the inner ring 42B of the casing-side restraining portion 22B is fitted into the outer ring 41B.

More specifically, the first protrusion 43B and the first depression 45B are disposed at the relative positions shown in FIG. 5, and then the inner ring 42B is moved toward the turbine portion 3 along the rotational axis L.

Once the first protrusion 43B is moved into the first groove 44B, the inner ring 42B is moved in the circumferential direction, and the inner ring 42B is rotated to a location where the first protrusion 43B and the wall portion 46B are overlapped with each other as viewed from the direction along the rotational axis L as shown in FIG. 6. Accordingly, fitting operation of the casing-side restraining portion 22B is completed.

Next, support of the scroll main body 21 by the horizontal restraining portion 23A and the vertical restraining portion 23B will be described with reference to FIGS. 7 to 10.

When the scroll main body 21 is supported by the casings 2A and 2C, as shown in FIGS. 7, 8 and 10, the second protrusions 51A and 51B fixed to the casings 2A and 2C are inserted respectively into the second depressions 52A and 52B provided in the scroll main body 21.

As shown in FIG. 8, the second protrusion 51A of the horizontal restraining portion 23A is inserted into the second depression 52A. Then, movement of the scroll main body 21 in the horizontal direction is restrained. A gap is provided between an inner radial end of the second protrusion 51A and the bottom surface of the second depression 52A, so that expansion and contraction of the scroll main body 21 in the radial direction are permitted.

By inserting the second protrusion 51B of the vertical restraining portion 23B into the second depression 52B as shown in FIG. 10, movement of the scroll main body 21 in the vertical direction is restrained. On the other hand, when a gap is provided between an inner radial end of the second protrusion 51B and the bottom surface of the second depression 52B, expansion and contraction of the scroll main body 21 in the radial direction are permitted.

According to the above-described configuration, by integrally forming the scroll main body 21, leakage of the working fluid outside as well as inflow of other fluid caused by inhalation of the other fluid into the scroll main body 21 from outside can be prevented. That is, when the scroll main body 21 has such a configuration that it is divided into two pieces, i.e., the upper casing and the lower casing, there is an adverse possibility that a working fluid may leak from the joint surface between the upper casing and the lower casing. In the case of the integrally formed scroll main body 21, since there is no joint surface, leakage of a working fluid can surely be prevented, and reliability of the gas turbine 1 can be improved.

By integrally forming the scroll main body 21, as compared with a case where the scroll main body 21 is divided into two pieces, the cylindrical channel 32 can be formed into such a shape that a pressure loss thereof is suppressed. That is, when the scroll main body 21 is divided into two pieces, since a space for disposing a member such as a bolt which fastens the upper casing and the lower casing to each other and an space for operating attachment or detachment of the bolt must be secured, the shape of the cylindrical channel 32 is limited. To the contrary, in the case where the scroll main body 21 is integrally formed in one piece, it is unnecessary to use the fastening bolt, the shape of the channel is not limited, and thus the channel shape causing a small pressure loss can be employed. Therefore, performance of the gas turbine 1 can be improved.

By integrally forming the scroll main body 21, as compared with the case where the scroll main body 21 is divided into two pieces, the scroll structure can be reduced in size. Specifically, when the scroll main body 21 is divided into two pieces, the flanges used for fastening the upper casing and the lower casing to each other project outward from the casings. To the contrary, in the case of the integrally formed scroll main body 21, since it is unnecessary to provide the flanges, the scroll main body 21 can be made smaller, and the gas turbine 1 can be reduced in size.

The scroll main body 21 is supported by the turbine portion-side restraining portion 22A, the casing-side restraining portion 22B, the horizontal restraining portion 23A and the vertical restraining portion 23B such that the scroll main body 21 can expand and contract in the radial direction. Therefore, it is possible to prevent misalignment of the scroll main body 21 which may be caused in a case where deformation of the scroll main body 21 is restrained, and damage to the scroll main body 21 caused by high stress.

For example, in a case where even a single fixed point is provided to the scroll main body 21, misalignment of the scroll main body 21 may be caused by uneven deformation. In the case where the fixed point is provided, there is an adverse possibility that thermal deformation of the scroll main body 21 is restrained and thermal stress is caused, and thus the scroll main body 21 is damaged.

When the scroll main body 21 is supported such that the scroll main body 21 can expand and contract along the radial direction, thermal deformation of the scroll main body 21 is not restrained, misalignment and thermal stress of the scroll main body 21 can be suppressed, and therefore reliability of the gas turbine 1 can be improved.

The technical scope of the present invention is not limited to the above embodiment, and the present invention can variously be modified within a range not departing from the subject matter of the present invention.

For example, although the present invention is applied to the axial-flow turbine in the above embodiment, the present invention is not limited to such an axial-flow turbine, but can also be applied to other kinds of turbines such as a centrifugal type turbine and a mixed-flow turbine.

The present invention can also be applied to general fluid machines such as a gas turbine of another type in which air is employed as a working fluid and combustion energy of fossil fuel or the like is used as a heat source, as well as a steam turbine, a compressor, and a pump. Applications of the present invention are not especially limited.

The invention claimed is:

1. A scroll structure of a rotary machine, comprising:

a scroll main body that entirely covers an area surrounding an annular channel extending in a circular shape about a rotational axis in a rotating portion of the rotary machine and a cylindrical channel extending from the annular channel and extending towards the rotating portion;

a casing constituting an outer shape of the rotary machine and accommodating the scroll main body therein; and a fitting portion that supports the scroll main body with respect to a support portion, so as to enable expansion and contraction of the scroll main body in a radial direction centered on the rotational axis, wherein the fitting portion includes:

a turbine portion-side restraining portion that restrains movement of the scroll main body along the rotational axis, with respect to the support portion, and a casing-side restraining portion that restrains movement of the scroll main body along the rotational axis, with respect to the support portion, wherein each of the turbine portion-side restraining portion and the casing-side restraining portion comprises:

a ring which is provided on the scroll main body, a ring which is provided on the support portion, protrusions which are disposed on the ring on the scroll main body, and which protrude in a radial direction;

a groove which is disposed on the ring which is provided on the support portion, the groove being open in the radial direction and into which the protrusions are fitted, and depressions which are formed in the ring which is provided on the support portion and which are formed in one wall of a pair of wall portions defining the groove and through which the protrusions pass by moving relative to the one wall, along the rotational axis, and wherein the turbine portion-side restraining portion and the casing-side restraining portion are disposed on opposite sides of the cylindrical channel.

2. A rotary machine comprising:

the scroll structure according to claim 1; and a turbine into which or from which a working fluid flows, between the turbine and the scroll structure, and which extracts a rotational driving force from the supplied working fluid.

3. A scroll structure of a rotary machine, comprising:

a scroll main body that entirely covers an area surrounding an annular channel extending in a circular shape about a rotational axis of a rotating portion of the rotary machine and a cylindrical channel extending from the annular channel and extending towards the rotating portion;

a casing constituting an outer shape of the rotary machine and accommodating the scroll main body therein; and a fitting portion that supports the scroll main body including the annular channel and the cylindrical channel with respect to the casing, so as to enable expansion and contraction of the scroll main body in a radial direction centered on the rotational axis, with respect to the casing, whilst restraining movement of the scroll main body along the rotational axis, wherein the fitting portion includes:

a turbine portion-side restraining portion that restrains movement of the scroll main body along the rotational axis, with respect to the casing, a casing-side restraining portion that restrains movement of the scroll main body along the rotational axis, with respect to the casing, a horizontal restraining portion that is disposed above the annular channel that restrains movement of the scroll main body in a horizontal direction with respect to the casing, and a vertical restraining portion that is disposed diagonally below the annular channel and that restrains movement of the scroll main body in a vertical direction with respect to the casing, wherein the casing-side restraining portion comprises:

protrusions which are disposed on the casing and which protrude in a radial direction; and depressions which are disposed on the scroll main body, and which are open in the radial direction and into which the protrusions are fitted, and wherein the turbine portion-side restraining portion and the casing-side restraining portion are disposed on opposite sides of the cylindrical channel.

* * * * *